United States Patent [19]

Snyder

[11] 4,212,489

[45] Jul. 15, 1980

[54] ELECTRICALLY OPERATED MULTIPLE SECURITY BOLT DOOR LOCKING DEVICE

[76] Inventor: Eugene T. Snyder, 5735 W. Florida Ave., Lakewood, Colo. 80206

[21] Appl. No.: 918,339

[22] Filed: Jul. 13, 1978

[51] Int. Cl.[2] ..... E05C 1/06

[52] U.S. Cl. ..... 292/33; 292/144; 292/333

[58] Field of Search ..... 292/33, 156, 157, 164, 292/144, DIG. 15, DIG. 25, 333; 70/82, DIG. 6 L

[56] References Cited

U.S. PATENT DOCUMENTS

| | | | |
|---|---|---|---|
| 228,323 | 6/1880 | Crandal | 292/333 |
| 436,405 | 9/1890 | Domer | 292/333 |
| 1,054,112 | 2/1913 | Handschuh | 292/144 |
| 1,422,589 | 7/1922 | McQuiston | 292/144 X |
| 2,070,803 | 2/1937 | Oblak | 292/144 |
| 2,772,905 | 12/1956 | Ousing | 292/144 |
| 2,879,725 | 3/1959 | Zuver | 292/144 X |
| 3,094,199 | 6/1963 | Wallmann | 292/144 X |
| 3,134,254 | 5/1964 | Richard | 292/144 X |
| 3,295,878 | 1/1967 | Houvener | 292/144 |
| 4,030,322 | 6/1977 | Pettit | 292/144 X |

*Primary Examiner*—J. Franklin Foss
*Attorney, Agent, or Firm*—Gregg I. Anderson

[57] ABSTRACT

An electrically operated multiple security bolt door locking device which serves to enhance the inherent strength of a door being so controlled and thereby providing maximum resistence to forceful entry. To this end a plurality of reinforced security bolts are provided in sufficient number thereof and disposed, preferrably externally, on wall immediately adjacent to said door and decoratively covered. Said bolt plurality is normally biased locked and electrically withdrawn, in concert, from locked position and retained in unlocked position while door is open. Said security bolt plurality is employed horizontally along a line juxtaposed with said wall and door.

5 Claims, 18 Drawing Figures

ELECTRICALLY OPERATED MULTIPLE SECURITY BOLT DOOR LOCKING DEVICE

This invention relates to improvements in door locking devices, more particularly to an improved means of resisting forceful entry.

BACKGROUND OF THE INVENTION

The present art in door locking devices is seriously lacking in its ability to resist forceful entry. This is true because people so inclined have learned of the inherent weaknesses of the present art.

Only one bolt is used in the prior art. There is no back-up provision for that bolt, increasing the possibility of a successful break-in upon its failure.

Locks of the present art are disposed within the door with the bolt employed through door edge to detent in door facing when closed. This practice provides for insufficient material (usually wood), remaining on either side of bolt and from detent, in door facing to inside edge of door facing, to resist a violent blow from a person's body or foot.

The most common type of lock of the present art is the self-latching type. With this lock, the bolt is spring biased to detent in door facing (closed), and is provided with a beveled forward end to facilitate closing. A plastic card or the like, slipped past door jam and pressed against said bevel, forces bolt back against biasing spring and out of detent.

These weaknesses are not applicable to the present invention as will become apparent.

The strength of a solid hardwood door is lost when just a small amount of wood is available to resist forceful entry.

SUMMARY OF THE INVENTION

Accordingly, it is an object of the present invention to provide an electrically operated multiple security bolt door locking system which will eliminate the above described weaknesses by providing security bolts in sufficient numbers to allow a door being so controlled to resist forceful entry and wherein said bolts cannot be forced out of locked position by a plastic card or the like.

A further object of the present invention is to provide said security bolts normally biased locked and an electrical means to withdraw said security bolts from locked position in concert. A still further object of the present invention is to provide steel reinforcement for said security bolts.

And yet another object of the present invention is to provide a means to retain said security bolts in unlocked position while door is open.

Additionally, it is an object of the present invention to provide means to dispose said locking unit where it will provide maximum strength to a given installation.

The security bolt door locking device therefor includes a plurality of bolts integrally connected adapted to extend from a wall mounting position across the interface between a door and a door frame to lock the opening of the door. The integrally connected bolts extend in horizontal fashion to a position outside of and abutting the edge of the door to be protected. Generally planar reinforcements extend outwardly from studs to which the locking device is mounted. The reinforcements have apertures through which each of the bolts is keyed. The bolts are biased by spring force in the extended or locked position across the door. Activation of a solenoid which is affixed to supporting studs adjacent to the door frame withdraws the bolts in concert by movement of a vertical member integrally connecting all the bolts. As the bolts are withdrawn past the door frame, a plurality of spring biased bolt retainers are permitted to extend from their mounting position within the door frame as the door is opened, and thereby maintain the bolts in a withdrawn position. When the door is closed a flange upon the bolt retainers is engaged by the edge of the door biasing the spring and withdrawing the bolt retainer. Once the bolt retainers are withdrawn the bolts are extended in concert to their normal locking postion.

DESCRIPTION OF THE PREFERRED EMBODIMENT

Figure 1:
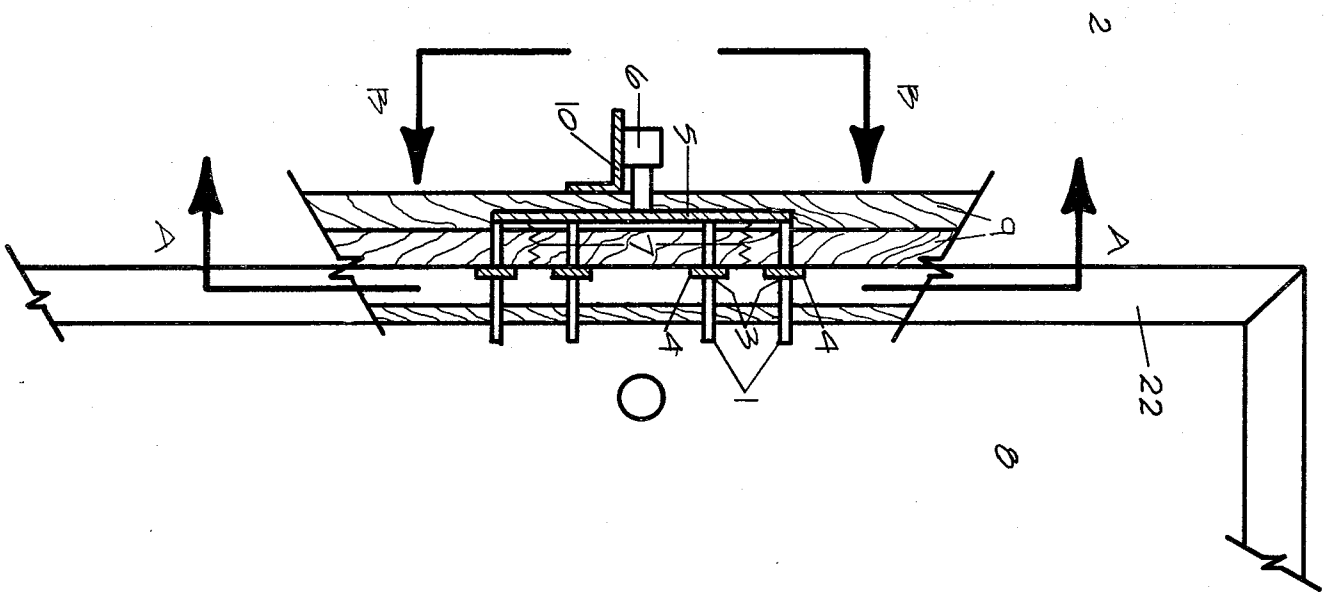
FIG. 1 is a side elevation showing locking unit mounted externally on wall and biased locked and wall covering cut away.
Figure 2:
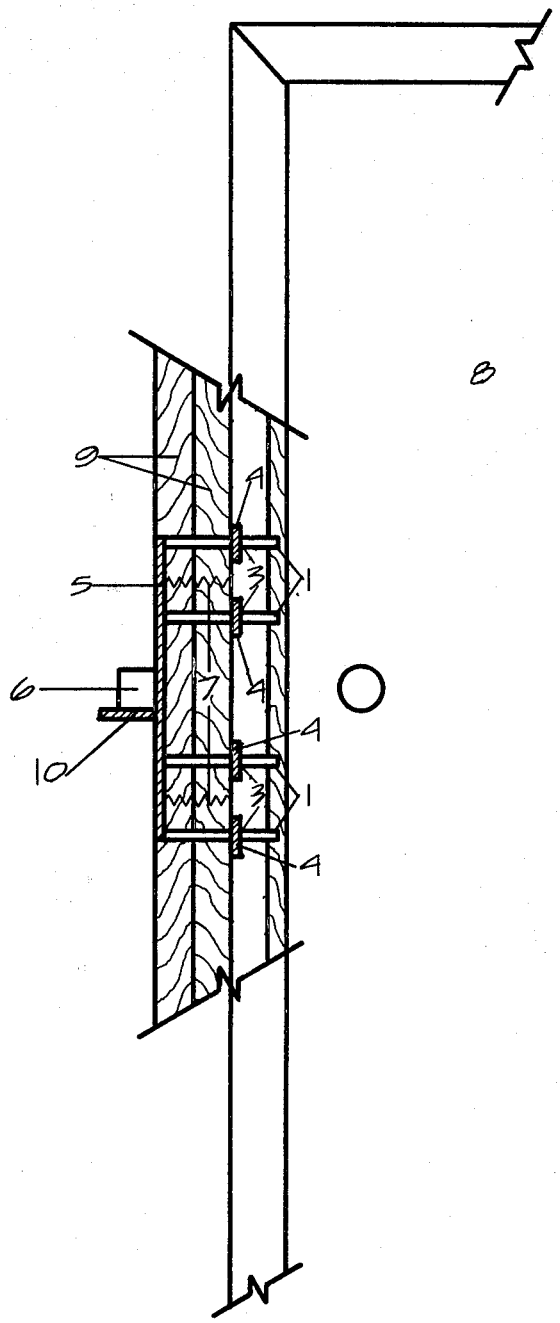
FIG. 2 is the same as FIG. 1 with security bolts withdrawn from locked position.

With reference to FIGS. 1 through 5, security bolts 1 are disposed externally on wall, 2 and are positioned horizontally and spaced vertically one from the other and supported by aperatures 3 provided in reinforcements 4 and by vertical member, 5 solenoid 6 and springs 7 are also attached to said vertical member.

Said security bolts 1 are biased locked by springs 7 and withdrawn in concert from locked position by solenoid 6. Said security bolts 1 are so employed along a line juxtaposed with wall 2 and door 8.

Said locking unit so described attached to exposed 2×4 studs 9 at bracket 10 and reinforcements 4 by bolts 11 where wall 2 covering has been cut away.

Figure 3:
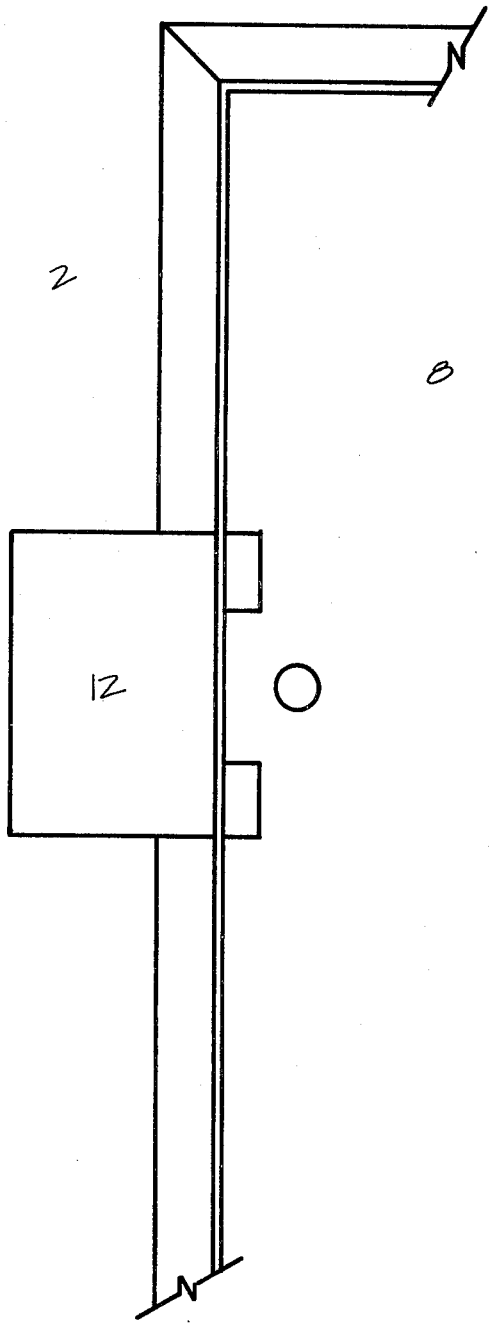
FIG. 3 is a side elevation showing decorative covering of unit.
Figure 4:
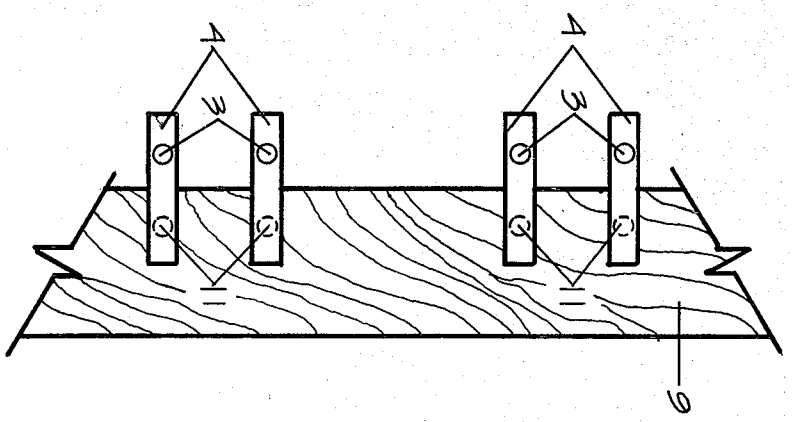
FIG. 4 is a view taken at A—A of FIG. 1.
Figure 5:
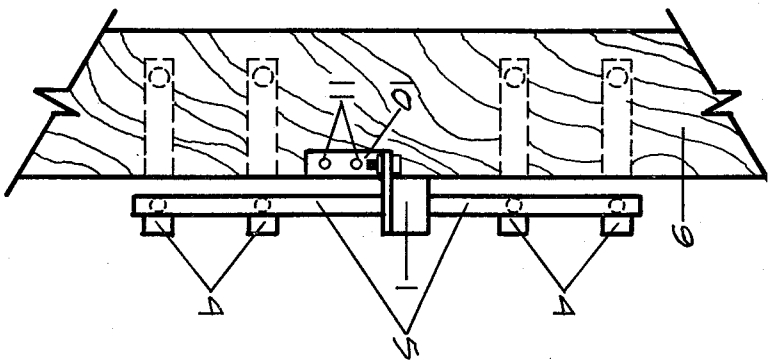
FIG. 5 is an end elevation taken at B—B of FIG. 1.
Figure 6:
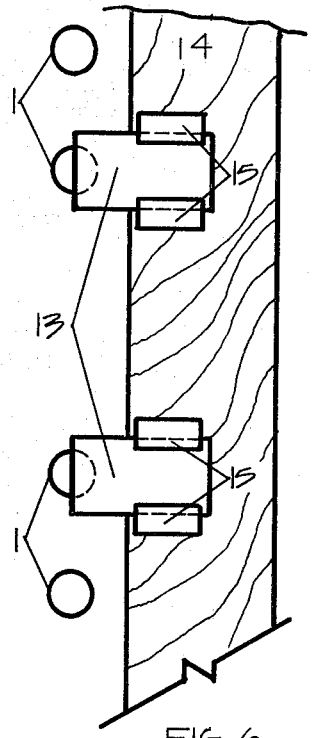
FIG. 6 is a fragment of door facing showing security bolt retainers.
Figure 7:
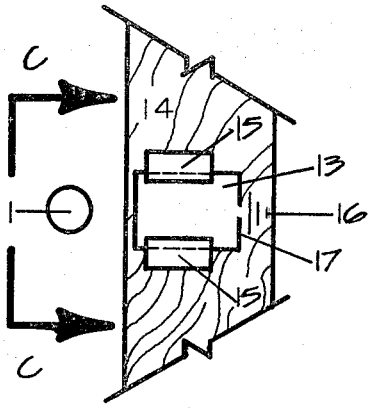
FIG. 7 is a fragment of door facing showing a security bolt retainer retracted and the end of a security bolt.
Figure 8:
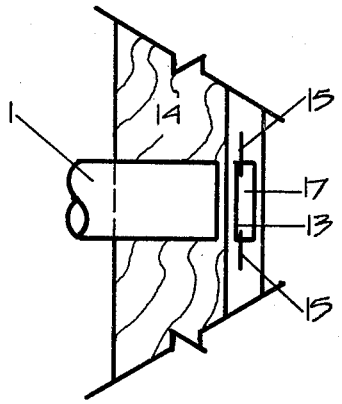
FIG.8 is a view taken at C—C of FIG. 7.
Figure 9:
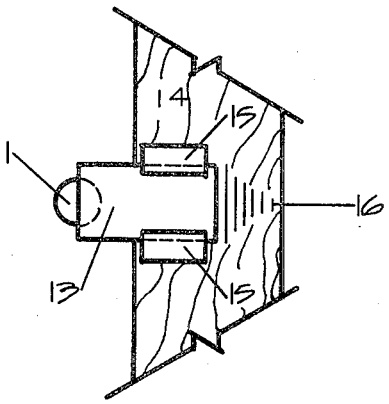
FIG. 9 is a fragment of door facing showing security bolt retainer extended.

Complete unit is decoratively covered as is shown in FIG. 3 by covering 12.

Said solenoid 6 will be energized only briefly so security bolt retainers 13 are provided in FIGS. 6 through 9 to retain said security bolts 1 in unlocked position while door 8 is open.

Said security bolt retainers, 13 are disposed on door facing 14 and supported by guides 15. The door facing 14 is the portion of a door frame 22 which receives the door 8 upon closing of the door.

Figure 10:
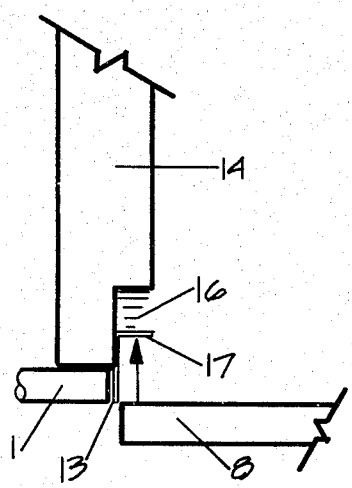
FIG. 10 is a top view showing closing and engaging security bolt flange.

When security bolt plurality 1 is retracted and said door is opened, springs 16, pressing against security bolt retainer flanges 17, bias said security bolt retainers 13 to extended position. As door 8 is closed, said security bolt retainer flanges 17 are engaged by said closing door 8, as in FIG. 10, thus retracting said security bolt retainers 13, allowing security bolt 1 plurality to return to locked position behind closed door 8.

FIGS. 11 through 18 show possible variations and substitutions.

Figure 11:
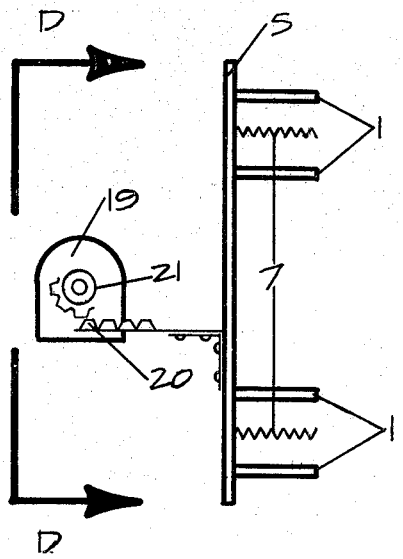
FIG. 11 is a side view showing an electric motor in place of solenoid.
Figure 12:
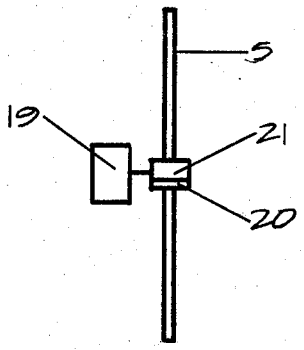
FIG. 12 is an end elevation taken at D—D of FIG. 11.
Figure 13:
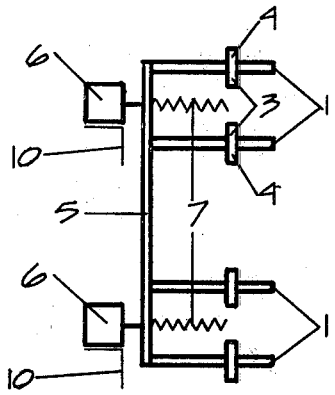
FIG. 13 is a side elevation showing two solenoids attached to locking unit.
Figure 14:
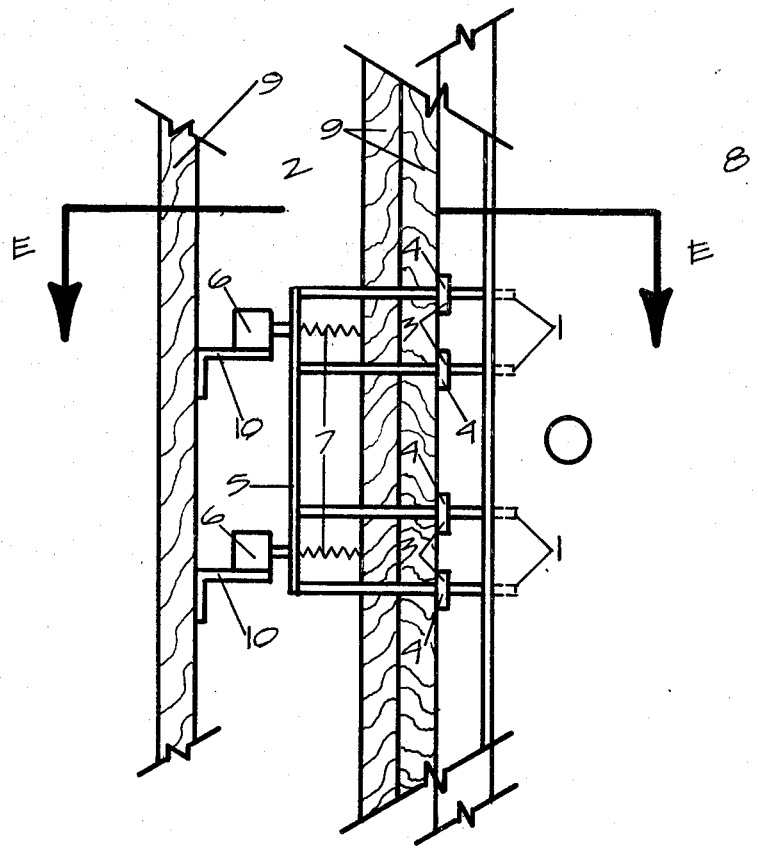
FIG. 14 is a side elevation showing wall covering cut away and locking unit disposed internally in wall.
Figure 15:
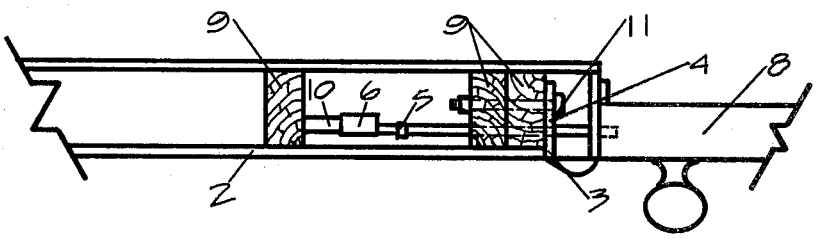
FIG. 15 is top view taken at E—E of FIG. 14.
Figure 16:
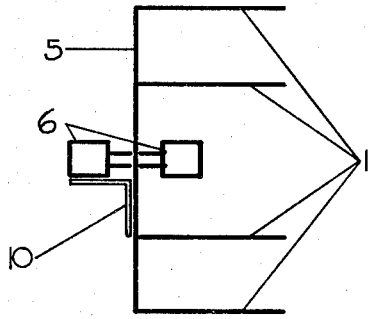
FIG. 16 is a side elevation showing a second solenoid as an electrical biasing means.
Figure 18:
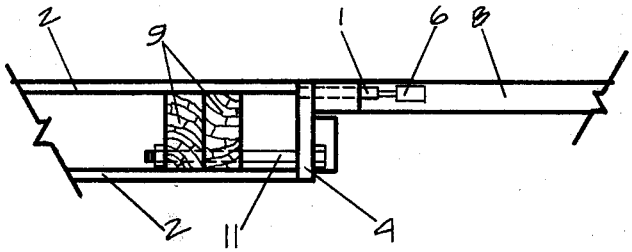
FIG. 18 is top view taken at F—F of FIG. 17.
Figure 17:
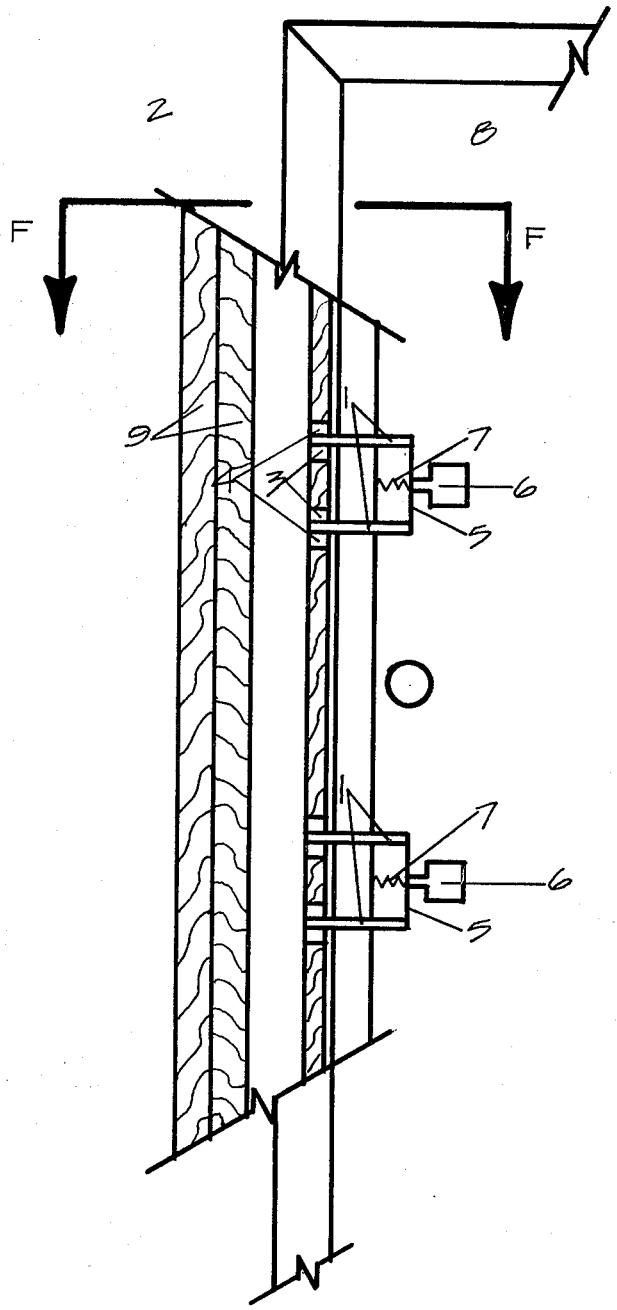
FIG. 17 is side elevation showing a cut away position of a door and locking unit mounted within said door.

More than one solenoid may be needed for a given installation. In FIGS. 11 and 12, a small electric motor 19 replaces solenoid 6, and either of these electrical means may replace biasing springs 7, as in FIG. 16. Said motor 19 withdraws security bolts 1 through rack 20 pinion 21 gears.

For maximum strength, said locking unit should be disposed externally on wall 2 as described and illustrated herein, but said unit may be disposed internally, within said wall 2 structure, or within said door 8 as necessity dictates.

OPERATION

Security bolts 1 of locking unit shown in FIG. 1 are in their normally biased locked position with said security bolt plurality overlapping door edge from wall 2 mounted position.

Reinforcements 4 provide supportive strength to said security bolt plurality through apertures 3 provided in said reinforcements.

As can readily be seen, security bolt plurality 1 so positioned enhances the inherent strength of said door, allowing said door to give considerable resistance to forceful entry.

Energizing solenoid 6 withdraws security bolts 1 allowing door to open. As said door opens, bolt retainers 13, in FIGS. 6 through 9, are biased into path of withdrawn security bolt plurality 1 retaining said bolts in unlocked position while door 8 is open. As said door closes, said door edge engages flanges 17 at rear of said retainers, withdrawing them from in front of said bolts 1, thus allowing said bolts to return to locked position behind closed door.

Although the present invention has been described with a certain degree of particularity, it is understood that the present disclosure has been made by way of example and changes in detail or structure may be without departing from the spirit of the invention, especially as defined in the appended claims.

I claim:

1. A locking system for a hinged door, said door adapted to open and close to a position flush with a face of a door frame, said door connected along one vertical side thereof to the door frame, said door frame and connected door disposed within a wall, said locking system comprising, in combination:

stud means of substantially the same thickness as said wall located immediately adjacent to said door frame across the door frame the hinge connection between the door frame and door;

a plurality of generally planar apertured reinforcements rigidly attached in generally vertical alignment to said stud means, the aperture of each of said reinforcements protruding away from said door when the door is in the closed position;

an equal plurality of bolts integrally connected, parallely aligned and reciprocatively received by the apertures of said reinforcement, said bolts moving in a movement path between an extended position crossing the interface between the door frame and the closed door, said bolts abutting against the closed door, and a withdrawn position wherein said bolts are not extended across the interface between the door frame and the closed door;

at least one generally planar bolt retainer mounted on the face of said door frame across the door frame from the hinge connection with the door, each retainer being biased to extend into the movement path of said bolts thereby preventing the movement of said bolts to the extended position, each bolt retainer further having a flange disposed at one end thereof adapted to engage said door upon closing of said door and to further move each bolt retainer out of the movement path of said bolts thereby permitting the plurality of bolts to extend;

means for selectively withdrawing in concert said bolts from their extended position to their withdrawn position, mounted to said stud means; and means for biasing said bolts toward their extended position said biasing means operatively connected between said stud means and said bolts.

2. The invention defined in claim 1 wherein said means to selectively withdraw said bolts in concert include:

a solenoid operatively connected to said plurality of bolts; and a bracket rigidly mounted to said stud means and adapted to support and hold said solenoid.

3. The invention defined in claim 2 wherein said means to selectively withdraw said bolts in concert include:

an electric motor;

rack and pinion gearing operably connecting said electric motor to said bolts; and a bracket rigidly mounted to said stud means and supporting said electric motor.

4. A locking system for a hinged door, said door adapted to open and close so as to be received within a facing of a door frame when closed, said door connected along one vertical side thereof to the door frame, said door and door frame disposed within a wall, said locking system comprising, in combination:

stud means of substantially the same thickness as the wall, said stud means being adjacent to the exterior of said door frame opposite the connection between the door and door frame;

a plurality of generally planar apertured reinforcements in spaced vertical alignment, said reinforcements fixed to said stud means intermediate between said door frame and said stude means, said apertured reinforcement extending a predetermined distance away from said closed door;

an equal plurality of horizontally directed bolts positioned external to said wall on said stud means parallely aligned along a vertical line, each of said bolts adapted to slide within apertured reinforcement and reciprocate between an extended position adjacent to and abutting against said closed door and a withdrawn position not adjacent to nor abutting against said closed door;

a vertical member operatively interconnecting all of said bolts for concerted movement of said bolts;

at least one generally planar bolt retainer mounted on the face of said door frame intermediate the door frame and the closed door; each bolt retainer having at one end a flange adapted to engage said door upon closing of said door, said bolt retainer further adapted to reciprocate between a position intermediate the withdrawn and extended positions of said bolts and a position completely contained within said door facing upon engagement of said flange with said door and closing of said door;

guides fixed to said door facing on either side of said bolt retainer between which said bolt retainer reciprocates;

first bias means maintaining said bolt retainer at a position between the withdrawn and the extended positions of said plurality of bolts;

means for selectively withdrawing in concert said bolts from their extended position to their withdrawn position, said withdrawing means mounted to said stud means; and second bias means, operably connected between said vertical member and said stud means, said second bias means biasing said bolts in their extended position.

5. The invention defined in claim 1 wherein said locking system is completely covered external to said wall having provision to allow said bolt to extend across said door and abut thereagainst.

* * * * *